United States Patent [19]

Sorensen

[11] 4,372,555

[45] Feb. 8, 1983

[54] BASKETBALL BACKBOARD

[76] Inventor: Roald H. Sorensen, 3224 Marie Dr., Raleigh, N.C. 27604

[21] Appl. No.: 310,062

[22] Filed: Oct. 9, 1981

[51] Int. Cl.[3] ..... A01B 63/08

[52] U.S. Cl. ..... 273/1.5 R; 33/379

[58] Field of Search ..... 273/1.5 R, 1.5 A; 33/333, 343, 379, 381–383, 370, 371

[56] References Cited

U.S. PATENT DOCUMENTS

| | | | |
|---|---|---|---|
| 155,635 | 10/1874 | Brotherton | 33/333 X |
| 1,017,811 | 2/1912 | Scelza | 33/343 X |
| 1,333,559 | 3/1920 | Moulton | 33/382 |
| 2,624,118 | 1/1953 | Anderson | 33/370 X |
| 3,180,035 | 4/1965 | Olexson et al. | 33/381 X |
| 3,233,897 | 2/1966 | Sheets | 273/1.5 R |
| 4,208,802 | 6/1980 | Berndt | 33/371 X |
| 4,212,123 | 7/1980 | Robin | 33/371 X |
| 4,228,982 | 10/1980 | Sellera | 33/370 X |
| 4,320,896 | 3/1982 | Engle et al. | 273/1.5 R |

OTHER PUBLICATIONS

Adams Plastics Inc. Catalog, 1/1980, Basketball Backboard Bumpers, No. 1800.

*Primary Examiner*—Paul E. Shapiro

*Attorney, Agent, or Firm*—Mills & Coats

[57] ABSTRACT

A basketball backboard which includes spirit levels mounted on the two side frame members and on the bottom frame member whereby the backboard can be leveled prior to play commencing and adjusted as necessary during play to ascertain vertical disposition. This invention is of particular usefulness when used in conjunction with glass backboards in that the same allows the board to be stress relieved which will prevent or greatly reduce the incidents of shattered backboards.

10 Claims, 4 Drawing Figures

BASKETBALL BACKBOARD

FIELD OF INVENTION

This invention relates to athletic equipment and more particularly to basketball goals and the proper orientation of the same.

BACKGROUND OF INVENTION

In the past the proper orientation of basketball goals has been a problem since appropriately the backboard should be at exactly the regulation height and absolutely vertical.

Although relatively heavy and structurally sound, mounting systems are used to support backboards in the play position, the pounding of the ball against such backboard combined with slam-dunk plays against the rim and board are further combined with temperature changes to cause the boards on even the most sophisticated mounting to become twisted or off absolute vertical disposition. When the above occurs, even in the slightest amount, the shots of the players can be affected.

Even worse, when twisting or warping tensions are placed on a tempered glass backboard, the game stress becomes multiplied many times over and can cause the board to shatter and disintegrate. This is not only costly in replacing of the board itself but also can be extremely expensive because of game delay if the game is on live television.

BRIEF DESCRIPTION OF INVENTION

After much research and study into the above-mentioned problems, the present invention has been developed to provide a means for assuring that basketball backboards are in absolute plumb and vertical alignment both before play begins and during play.

To accomplish the above, a series of level indicating means are provided for use in conjunction with the backboard and are so situated that they can be readily checked from the playing floor by the referee or other interested persons. By keeping a check on the disposition of the boards, better play can be accomplished and the incident of shattered boards can be greatly reduced if not for all practical purposes eliminated.

In view of the above, it is an object of the present invention to provide a means for indicating when torsion has been placed on a tempered glass backboard in order that such condition can be corrected.

Another object of the present invention is to provide a means for assuring that a backboard is in proper alignment relative to vertical disposition of the outer edges of the board as well as horizontal disposition of the horizontal axis thereof.

Another object of the present invention is to provide a means for readily determining whether torsion exists in a backboard.

Another object of the present invention is to provide a simple, inexpensive and yet highly efficient means for determining whether a basketball backboard is disposed in proper position.

Another object of the present invention is to provide a means for assuring that a tempered glass backboard is torsion free and in proper vertical alignment.

Other objects and advantages of the present invention will become apparent and obvious from a study of the following description and the accompanying drawings which are merely illustrative of such invention.

DETAILED DESCRIPTION OF INVENTION

Figure 1:
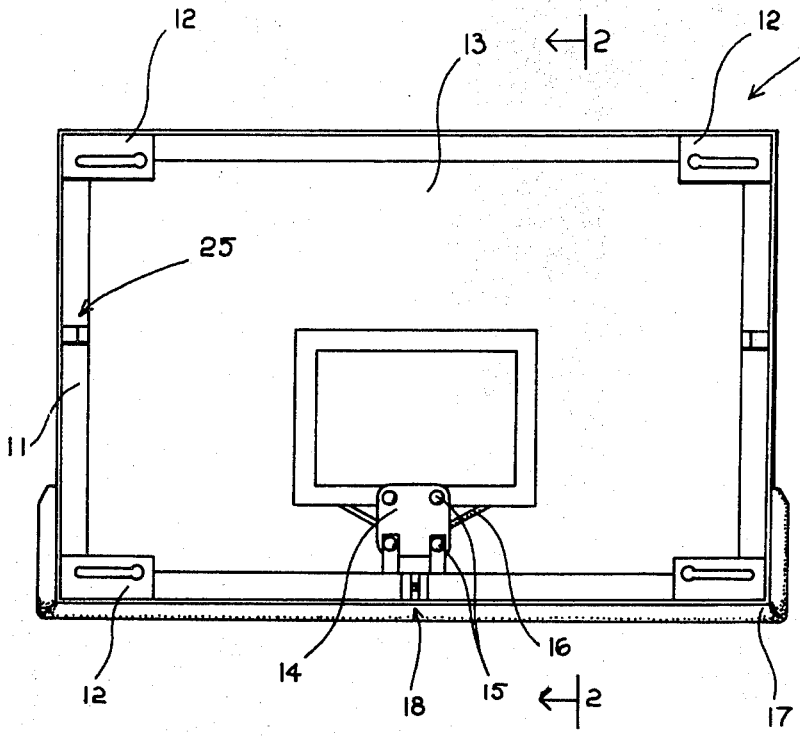
FIG. 1 is a rear elevational view of the improved basketball backboard of the present invention.
Figure 2:
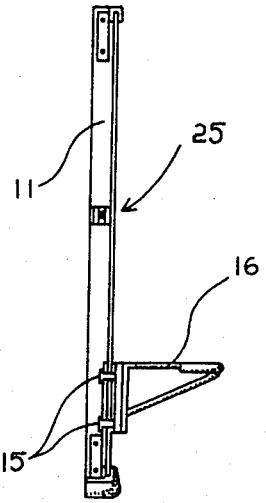
FIG. 2 is a sectional view taken through lines 2—2 of FIG. 1.
Figure 4:
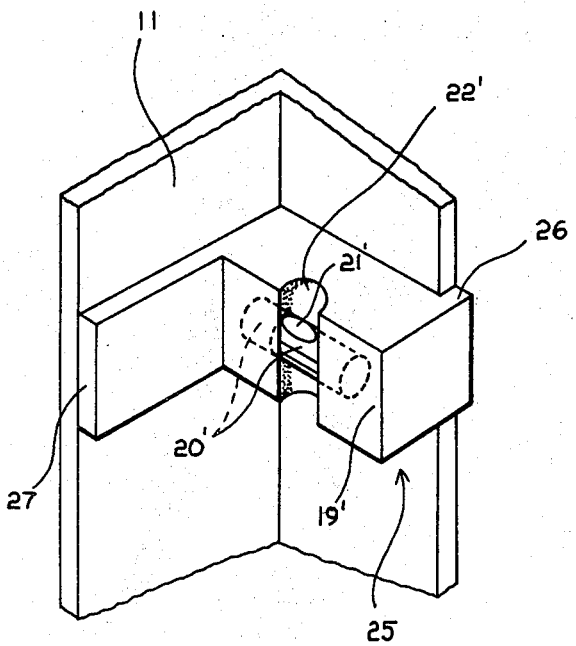
FIG. 4 is an enlarged fragmentary view of one of the end alignment indicating means.
Figure 3:
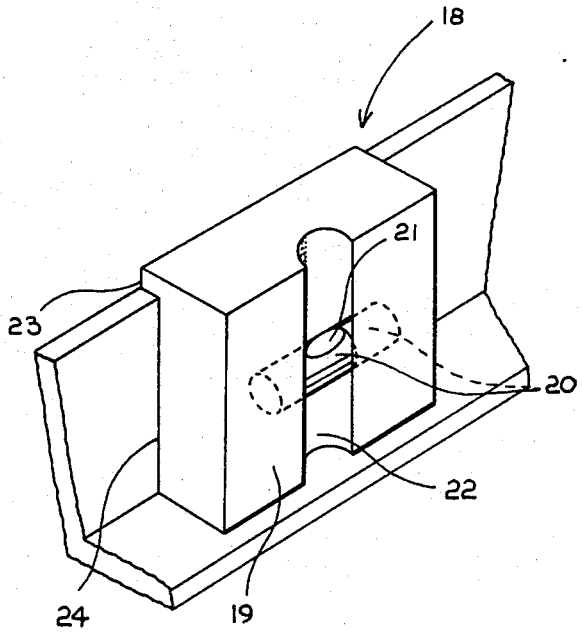
FIG. 3 is an enlarged fragmentary view of the centrally disposed alignment indicating means.

With further reference to the drawings, the improved basketball backboard of the present invention, indicated generally at 10, includes a backboard member 13 which is supportingly mounted within peripheral frame 11. This frame 11 is constructed from stock angle iron in the normal manner of such devices.

At the corners of frame 11 are mounting tabs 12 which secure the basketball backboard to a standard supporting frame (not shown).

A basketball goal 16 is disposed on the front of backboard 13 and is through bolted as indicated at 15 to backing plate 14.

A player protective pad 17 is provided across the bottom and lower corners of peripheral frame 11 as can clearly be seen in FIG. 1.

An alignment indicating means indicated generally at 18 is disposed parallel to the horizontal axis of the board member 13. This indicating means can be mounted either along the upper edge of the backing plate 14 as indicated in dotted lines in FIG. 1, or on the lower portion of the peripheral frame 11 as shown in solid lines in FIG. 1.

The horizontal alignment indicating means 18 includes a body portion 19 which has disposed therein a highly sensitive spirit level 20. Within the spirit level tube 20 is an indicating bubble 21.

A vertically disposed open area or sight 22 is provided which is preferably only as far across as bubble 21 is wide.

The above-described configuration has two purposes. First, the vertical sight allows the bubble to be readily seen from below and secondly, since the spirit level is of the sensitive type, the alignment is either correct or not correct because the bubble can either be seen or not seen thus eliminating officials taking the position that the board is "almost level". In other words because of the particular configuration of the level of the present invention, either the bubble can be seen (the board is horizontal) or the bubble can't be seen (the board is not horizontal).

To assure that the horizontal alignment indicating means 18 is in true alignment with the basketball backboard 10, a lip or flange 23 is provided on the upper portion of body 19. With a self-adhesive placed on the back surface 24 of body 19 and with lip or flange 23 placed juxtaposed to either the upper edge of the lower portion of peripheral frame 11 or the upper edge of backing plate 14, the alignment indicator 18 can be properly oriented and held in position. Since self-adhesing surfaces are well known to those skilled in the art, further detailed discussion of this portion of the present invention is not deemed necessary.

Vertical alignment indicating means shown generally at 25 are disposed at each end of peripheral frame 11 and indicate when the board is plumbed and without twist. Only one of the vertical alignment indicating means would be necessary if the board was completely rigid to determine vertical alignment. Boards are not, however, completely rigid and, therefore, plumb readings are taken from both ends thereof to make certain that there is no torsion causing twist in the board which could cause the same to shatter during play.

Vertical alignment indicating means 25 are composed of a body 19', a spirit level or tube 20' disposed within said body and containing a highly sensitive bubble indicator 21'. A sight 22' is vertically disposed similar to indicating means 18.

An edge lip 26 is provided on one end of body 19' and a flange 27 is provided on the other end. Lip 26 is adapted to engage and lie juxtaposed to the rear edge or peripheral frame 11 while flange 26 is adapted to lie juxtaposed to the forward angular portion thereof. Again a self-sticking adhesive is used on the back surface 24' of body 19' and once the vertical alignment indicator is disposed as described above, accurate vertical or plumb determinations can be readily made by simply standing below the board 10 and looking up at sight 22'.

From the above it can be seen that an improved basketball backboard is provided whose horizontal disposition and plumb can be readily determined by viewing the same from the playing floor. There are no "ifs, ands and buts" about whether the board is leveled and plumbed since the bubbles are either in the sight or not the sight and thus either correctly disposed or incorrectly indisposed. Level and plumb as well as twist can be determined through coordinated viewing of the indicating means of the present invention which, when properly used, will stress relieve the backboard as well as assure its proper disposition relative to the playing surface.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. An improved basketball backboard generally vertically disposed above a playing surface and having end portions of the improvement, comprising: a first alignment indicating means secured adjacent one of said ends of said backboard; a second alignment indicating means secured adjacent the opposite end of said backboard from said first alignment indicating means; and means for adjusting the disposition of said backboard relative to said playing surface whereby both proper vertical alignment of said backboard as well as elimination of internal stress created by twist mounting and similar stress related conditions within said board can be eliminated.

2. The improved basketball backboard of claim 1 wherein at least one of said alignment indicating means is of the spirit level type.

3. The improved basketball backboard of claim 2 wherein a limited sight is provided within which to read said spirit level.

4. The improved basketball backboard of claim 3 wherein said limited sight is in the form of a generally vertically disposed groove.

5. The improved basketball backboard of claim 1 wherein at least one of said alignment indicating means is mounted on a support frame used in conjunction with said backboard.

6. The improved basketball backboard of claim 1 wherein at least one additional alignment indicating means is mounted on said backboard so that horizontal disposition can be determined for the horizontal axis of said generally vertically disposed board.

7. The improved basketball backboard of claim 6 wherein said additional alignment indicating means is mounted on a support frame used in conjunction with said backboard.

8. The improved basketball backboard of claim 1 wherein said alignment indicating means are in the form of a spirit level type device which includes at least one flange means for assuring proper mounting alignment of said alignment indicating means relative to said backboard.

9. The improved basketball backboard of claim 8 wherein a limited sight is provided within which to read said spirit level.

10. The improved basketball backboard of claim 9 wherein said limited sight is in the form of a generally vertically disposed groove.

* * * * *